US005386970A

United States Patent [19]

Trant

[11] Patent Number: 5,386,970

[45] Date of Patent: Feb. 7, 1995

[54] PORTABLE WINCH POWER DRIVE

[76] Inventor: Carl Trant, Rte. 20, Palmer, Mass. 01069

[21] Appl. No.: 479,649

[22] Filed: Feb. 14, 1990

[51] Int. Cl.[6] ..... B66D 1/00

[52] U.S. Cl. ..... 254/362; 254/344

[58] Field of Search ..... 242/283, 323; 254/342, 254/344, 362, 371; 81/54, 57, 57.11, 57.14

[56] References Cited

U.S. PATENT DOCUMENTS

| | | | |
|---|---|---|---|
| Re. 30,423 | 10/1980 | Hutton et al. | 254/344 |
| 2,740,507 | 4/1956 | Shaff | 81/57.11 |
| 2,900,856 | 8/1959 | Maier | 81/57.29 X |
| 2,955,496 | 10/1960 | Torre | 81/57.14 |
| 3,126,166 | 3/1964 | Weinberg | 242/323 |
| 3,474,922 | 10/1969 | Wood et al. | 254/362 |
| 4,151,981 | 5/1979 | Gennep | 254/375 X |
| 4,171,651 | 10/1979 | Dacunto | 81/57.29 |
| 4,196,889 | 4/1980 | Dudek | 254/344 |
| 4,346,630 | 8/1982 | Hanson | 81/57.29 X |
| 4,462,282 | 7/1984 | Biek | 81/57.11 |
| 4,474,077 | 10/1984 | Debelius | 81/57.11 X |
| 4,484,871 | 11/1984 | Adman et al. | 81/57.14 X |
| 4,485,698 | 12/1984 | Adman et al. | 81/57.11 |
| 4,524,649 | 6/1985 | Diaz et al. | 81/57.29 X |
| 4,627,374 | 12/1986 | Wright | 254/371 |
| 4,905,423 | 3/1990 | van Laere | 81/464 X |
| 4,920,831 | 5/1990 | Huang | 81/57.14 X |
| 4,924,734 | 5/1990 | Bochman, Jr. | 81/57.12 |
| 5,048,799 | 9/1991 | Aronowitsch | 254/371 |

*Primary Examiner*—Katherine Matecki

*Attorney, Agent, or Firm*—Fishman, Dionne & Cantor

[57] ABSTRACT

A power handle for rotating the capstan of a manual winch about its axis is disclosed. The handle includes a housing, a motor, a star stub for removably securing the handle to the capstan and rotating the capstan relative to the housing, a gear reduction unit for connecting the motor with the star stub and a handle for manually securing the housing to prevent rotation of the housing relative to the axis of the capstan.

16 Claims, 1 Drawing Sheet

PORTABLE WINCH POWER DRIVE

TECHNICAL FIELD

The present invention relates to winches and more particularly, to winches for use on sailboats.

BACKGROUND

A typical sailboat includes a number of lines, e.g., halyards, sheets, outhauls and boom vangs, that must be manipulated in order to control the shape of the sails. Boats, other than small day sailers, typically include winches for providing mechanical advantage in manipulating the various lines. Manual winches and electric winches are each conventional in the art. A manual winch includes a capstan mounted for rotation about a central axis. The capstan of a manual winch has a socket for removably securing a winch handle to the capstan. The capstan is rotated manually by means of the winch handle. An electric winch includes an electric motor, typically mounted below deck, for rotating the capstan. Electric winches are much larger, heavier and more expensive than comparable manual winches.

SUMMARY OF THE INVENTION

A power handle for operating a winch is disclosed. The handle includes a housing, a drive means operatively associated with said housing means and removably securable to said capstan for rotating said capstan relative to said housing means, and handle means for manually securing the housing to prevent rotation of the housing relative to the central axis of the winch.

DETAILED DESCRIPTION OF THE INVENTION

Figure 1:
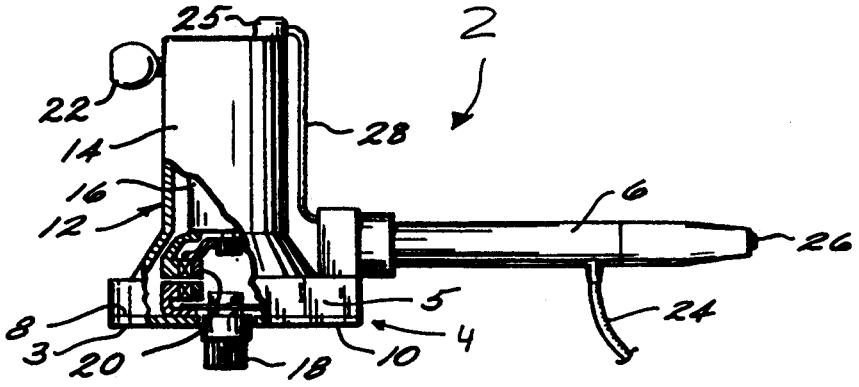
FIG. 1 shows a partially broken away side view of the power handle of the present invention.
Figure 2:
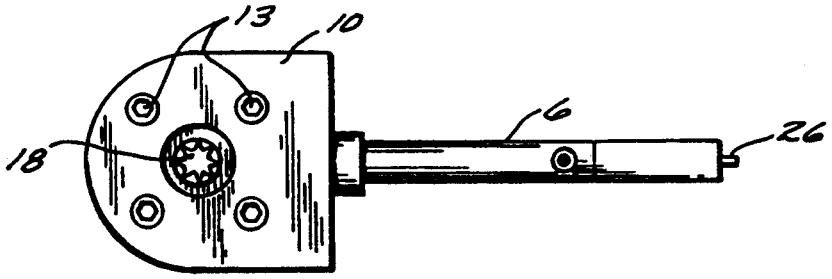
FIG. 2 shows a bottom view of the power handle of the present invention.

The power handle of the present invention is shown in FIGS. 1 and 2. The power handle 2 includes a housing 4 and a handle 6 secured to the housing 4. The housing 4 includes a flat plate 3 and a cover 5. Plate 3 has a top surface 8 and a bottom surface 10. Plate 3 includes a bore through the plate 3 from the top surface 8 to the bottom surface 10. A drive unit 12 is secured to the top surface of the plate 3 by bolts 13. A second handle 22 is provided on the drive unit 12.

Drive unit 12 includes housing 14, a D.C. electric motor 16, a star stub 18 and a planetary gear reduction unit 20 for mechanically coupling the motor 16 with the star stub 18. Suitable drive units are commercially available. A drive unit made by Superwinch, Inc. which weighs about 20 pounds, draws 80 amps and delivers about 2000 ft lb of torque has been found to be particularly suitable for use as the drive unit of the present invention.

The planetary gear reduction unit 20 is conventional and is described in U.S. Pat. No. 3,474,922, the disclosure of which is incorporated herein by reference. The unit 20 includes a planet carrier operatively associated with the motor 16, a pair of diametrically spaced planet gears carried by the planet carrier, a fixed ring gear engaging the planetary gears and a driven ring gear engaging the planet gears and secured to the star stub 18. The planetary gear reduction unit 20 of the present invention provides a reduction between about 75 motor revolutions: 1 star stub revolution to about 175 motor revolutions: 1 star stub revolution. Preferably, the planetary gear reduction unit provides a reduction of about 125:1.

Current is supplied to the motor by an electrical circuit which includes power cords 24 and 28, reverse switch 25 and power switch 26. Reverse switch 25 allows the operator to reverse polarity of the electrical current supplied to motor 16 and thereby rotate the star stub 18 in either a clockwise or counter clockwise direction. The reverse feature is particularly useful for operating two speed winches. Power switch 26 operates a conventional electrical relay (not shown) mounted with the handle 6. The switch 26 is biased in the "off" position as a safety measure, i.e. the switch 26 must be held in the "on" position by the operator so that the power to the motor is cut if the handle slips out of the operators grip. Power cord 24 is adapted for connecting to a conventional DC power source e.g. a marine battery. Power cords 24 and 28 are of suitable size to allow the required current be drawn by motor 16. Preferably the power cords 24 and 28 each comprise a bundle of three insulated 10 gauge wires and allow a current of about 35 amps to about 80 amps to be drawn by motor 16.

Figure 3:
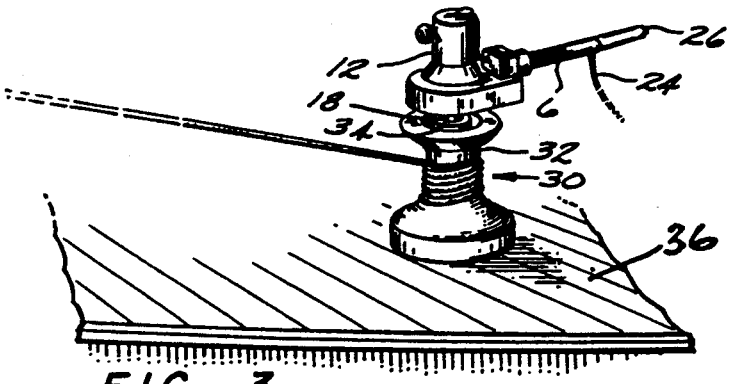
FIG. 3 shows a perspective view of the power handle of the present invention in use.

FIG. 3 shows the power handle of the present invention in operation. Winch 30 is mounted on the deck 36 of the sailboat. The winch 30 includes a capstan 32. The capstan is mounted for rotation about a central axis and includes a socket 34 for removably securing a winch handle to the capstan. The star stub 18 of the handle of the present invention 2 is secured within the socket 34 of capstan 32. The power handle 2 is operated by selecting a direction of rotation with switch 25, holding the handle 6 and, optionally, handle 22 to manually secure the housing 4 and operating switch 26 to supply electric current to the motor 16 to rotate the star stub 18 and capstan 32, secured to the star stub 18.

The winch handle of the present invention provides a portable light weight and inexpensive means for electrically driving manual winches. The handle may be used in other applications requiring a portable high torque driver, e.g. operating large valves.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A power handle for operating a marine winch, said winch having a capstan mounted for rotation about a central axis; and said capstan including a socket for receiving a star stub to removably secure a winch handle to the capstan comprising:

a housing including a flat plate having a top surface and an opposed bottom surface and having a bore through the plate from the top surface to the bottom surface;

drive means operatively associated with said housing for rotating said capstan relative to said housing, said drive means secured to the top surface of the plate, said drive means including star stub output means, extending from the drive means through the bore and projecting beyond the bottom surface of the plate, for removably securing the power handle to the capstan; and handle means for manually securing said housing to prevent rotation of the housing relative to the central axis.

2. The handle of claim 1, wherein the drive means comprises means for rotating said star stub output means relative to said housing.

3. The handle of claim 2, wherein the means for rotating comprises a planetary gear means.

4. The handle of claim 3, wherein the planetary gear means comprise a planet carrier, a pair of diametrically spaced planet gears, carried by the planet carrier, a fixed ring gear engaging said planet gears and a driven ring gear engaging said planet gears and secured to said output means.

5. The handle of claim 3, wherein the planetary gear means provides a reduction of between about 75/1 and about 175/1.

6. The handle of claim 3, wherein the means for rotating further comprises:

an electric motor secured to said housing and operatively associated with said planetary gear means for driving said planetary gear means; and supply means for supplying electrical current to said motor.

7. The handle of claim 6, wherein the supply means comprises:

means for electrically connecting the motor to a source of electrical current; and switch means for interrupting the electrical connection between the motor and the source of electrical current.

8. The handle of claim 7, further comprising resilient means for urging the switch means to interrupt the electrical connection between the motor and source of electrical current.

9. The handle of claim 7, wherein the means for electrically connecting allow a current of about 35 amps to about 80 amps to be drawn by the motor.

10. The handle of claim 6, wherein the electric motor delivers about 2000 ft lb of torque.

11. The handle of claim 1, wherein the handle means comprises an elongated member from the plate along an axis parallel to the top and bottom surfaces of the plate.

12. A power handle for operating a marine winch, said winch having a capstan mounted for rotation about a central axis and said capstan including a socket for receiving a star stub to removably secure a winch handle to the capstan, said power handle comprising:

a housing including a flat plate having a top surface and an opposed bottom surface and having a bore through the plate from the top surface to the bottom surface;

drive means operatively associated with the housing for rotating the capstan relative to the housing, said drive means being secured to the top surface of the plate and comprising:

star stub output means for removably securing the handle to the capstan, said output means extending from the drive means through the bore and projecting beyond the bottom surface of the plate;

planetary gear means for rotating said output means, and electric motor means secured to the housing, for driving the planetary gear means;

means for electrically connecting the motor means to a source of electrical current;

switch means for interrupting the electrical connection;

manually overrideable resilient means for urging the switch means to interrupt the electrical connection; and handle means for manually securing the housing to prevent rotation of the housing relative to the central axis, said handle means comprising an elongated member secured to the housing and extending along a second axis, wherein the second axis is perpendicular to the central axis.

13. The handle of claim 12, wherein the planetary gear means comprise a planet carrier, a pair of diametrically spaced planet gears, carried by the planet carrier, a fixed ring gear engaging said planet gears and a driven ring gear engaging said planet gears and secured to said output means.

14. The handle of claim 13, wherein the planetary gear means provides a reduction of between about 75/1 and about 175/1.

15. The handle of claim 12, wherein the electric motor delivers about 2000 ft lb of torque.

16. The handle of claim 12, wherein the means for electrically connecting allow a current of about 35 amps to about 80 amps to be drawn by the motor.

* * * * *